US006987868B1

(12) United States Patent
Atarashi et al.

(10) Patent No.: US 6,987,868 B1
(45) Date of Patent: Jan. 17, 2006

(54) GENUINE/COUNTERFEIT DISCRIMINATING METHOD, GENUINE/COUNTERFEIT DISCRIMINATION OBJECT, AND GENUINE/COUNTERFEIT DISCRIMINATING DEVICE

(75) Inventors: Takafumi Atarashi, Tokyo (JP); Katsuto Nakatsuka, 3-5-1403, Moniwadai 4-chome, Taihaku-ku, Sendai-shi, Miyagi 982-0252 (JP)

(73) Assignees: Nittetsu Mining Co., Ltd., Tokyo (JP); Katsuto Nakatsuka, Miyagi (JP)

( * ) Notice: Subject to any disclaimer, the term of this patent is extended or adjusted under 35 U.S.C. 154(b) by 0 days.

(21) Appl. No.: 09/856,957

(22) PCT Filed: Nov. 25, 1999

(86) PCT No.: PCT/JP99/06586
§ 371 (c)(1),
(2), (4) Date: May 29, 2001

(87) PCT Pub. No.: WO00/33263

PCT Pub. Date: Jun. 8, 2000

(30) Foreign Application Priority Data

Nov. 27, 1998 (JP) ..... 10-337733
Nov. 22, 1999 (JP) ..... 11-331531

(51) Int. Cl.
*G06K 9/00* (2006.01)

(52) U.S. Cl. ..... 382/112; 382/135

(58) Field of Classification Search ..... 382/112, 382/135, 139, 140, 143, 182, 206, 207, 218, 382/224, 318, 320; 902/7, 28; 434/110; 209/534; 283/72, 83, 85, 88, 89, 95, 96, 283/113, 114
See application file for complete search history.

(56) References Cited

U.S. PATENT DOCUMENTS 4,044,231 A * 8/1977 Beck et al. ..... 235/488
4,114,804 A * 9/1978 Jones et al. ..... 235/476
5,138,604 A * 8/1992 Umeda et al. ..... 369/103

(Continued)

FOREIGN PATENT DOCUMENTS

GB 1193511 6/1970

(Continued)

*Primary Examiner*—Andrew W. Johns
*Assistant Examiner*—Shervin Nakhjavan
(74) *Attorney, Agent, or Firm*—Sughrue Mion, PLLC

(57) ABSTRACT

A genuine/counterfeit discrimination method, comprising identifying a combination of at least two of an electric field pattern, a magnetic pattern, an electron beam responsive pattern, and reflection or absorption patterns of visible light, ultraviolet light, and infrared light using an electric field, a magnetic field, an electron beam, visible light, ultraviolet light, or infrared light. A genuine/counterfeit discrimination object, wherein a combination of at least two of an electric field pattern, a magnetic pattern, an electron beam responsive pattern, and reflection or absorption patterns of visible light, ultraviolet light, and infrared light can be identified therein using an electric field, a magnetic field, an electron beam, visible light, ultraviolet light, or infrared light. And a genuine/counterfeit discrimination device comprising at least two devices selected from a device for identifying an electric field pattern, a device for identifying a magnetic pattern, a device for identifying an electron beam responsive pattern, a device for identifying a visible-light pattern, a device for identifying an ultraviolet-light pattern, and a device for identifying an infrared-light pattern and further comprising a device for comparing and identifying patterns obtained with these identification devices.

13 Claims, 7 Drawing Sheets

U.S. PATENT DOCUMENTS

| | | | | | |
|---|---|---|---|---|---|
| 5,235,652 | A | | 8/1993 | Nally | 382/112 |
| 5,573,584 | A | | 11/1996 | Ostertag et al. | 106/417 |
| 5,719,948 | A | * | 2/1998 | Liang | 382/112 |
| 5,771,315 | A | * | 6/1998 | Matsuyama | 382/191 |
| 5,790,693 | A | | 8/1998 | Graves et al. | 382/135 |
| 5,856,048 | A | * | 1/1999 | Tahara et al. | 430/1 |
| 6,560,355 | B2 | * | 5/2003 | Graves et al. | 382/135 |

FOREIGN PATENT DOCUMENTS

| | | |
|---|---|---|
| JP | 6-44437 | 2/1994 |
| JP | 7-12763 | 1/1995 |
| JP | 8-305923 | 11/1996 |
| WO | WO 97/15904 | 5/1997 |
| WO | 98/07792 | 2/1998 |

* cited by examiner

GENUINE/COUNTERFEIT DISCRIMINATING METHOD, GENUINE/COUNTERFEIT DISCRIMINATION OBJECT, AND GENUINE/COUNTERFEIT DISCRIMINATING DEVICE

TECHNICAL FIELD

The present invention relates to a genuine/counterfeit discrimination method, a genuine/counterfeit discrimination object, and a genuine/counterfeit discrimination device. More particularly, the present invention relates to a genuine/counterfeit discrimination method that can heighten the effect of preventing the counterfeit of paper money, securities, and the like, and to a genuine/counterfeit discrimination object and a genuine/counterfeit discrimination device each for use in the method.

BACKGROUND ART

Paper money and merchandise coupons, gift certificates, event tickets, securities, and the like have conventionally been used in the form of a printed matter as indexes of the levels of value of the economy, distribution, and markets and in order to smooth these. These printed matters usually are pieces of paper or the like, which bear particular matters, or to which particular matters have been imparted by printing, etc. Such printed matters are lightweight and small and are convenient for carrying, storage, and use. However, because materials familiar to the public, such as pieces of paper, are used, there have been cases where such printed matters are illegally copied or counterfeit.

For the purpose of preventing such counterfeit, the imprint of a seal possessed by the publisher, a signature, a watermark, and the like have been used from long ago as means for identification. However, these identification means are easily faked by persons having a special skill, or by means of the copying/printing technology that has progressed recently, etc. Although such means are still in use at present, the actual reliability thereof is decreasing. In recent years, a bar code mark or the like has been used. However, since this bar code mark is an inorganic pattern composed of lines, it impairs the elegant image of the security and, further, has a drawback in that it is easily faked by the advanced technology of image analysis, copying, printing, etc.

Furthermore, a technique is being employed in which the security is produced as a magnetic card or a printed matter obtained through printing with a magnetic ink, and the magnetism thereof is identified. However, the magnetic card and the printed matter produced with a magnetic ink have had problems in that they have an impaired appearance due to the black or black-brown tone generally possessed by magnetic powders, and in that they are easily counterfeit because use of a magnetically identifying function is readily noticed. Still further, a technique which is being employed is to incorporate a fluorescent substance into a printing ink and identify the visible to fluorescent color of the printed matter. However, this technique, in which a visible to fluorescent color is identified, is intended to be used usually in such a manner that the printed matter is illuminated with a fluorescent lamp, and the resultant color development is identified with the naked eye. Hence, this technique is unsuitable for use in strict genuine/counterfeit discrimination.

As described above, the conventional techniques for genuine/counterfeit discrimination are still unsatisfactory.

DISCLOSURE OF THE INVENTION

Accordingly, an object of the present invention is to provide a technique for genuine/counterfeit discrimination that is more accurate than the conventional techniques for genuine/counterfeit discrimination, and that can heighten the effect of preventing the counterfeit of securities and the like.

As a result of intensive investigations, the present inventors have eliminated the drawbacks of conventional techniques by employing the following constitutions. The present invention has thus been achieved.

Namely, the present invention is as follows.

(1) A genuine/counterfeit discrimination method, comprising identifying a combination of at least two of an electric field pattern, a magnetic pattern, an electron beam responsive pattern, an X-ray responsive pattern, and reflection or absorption patterns of visible light, ultraviolet light, and infrared light using an electric field, a magnetic field, an electron beam, an X-ray beam, visible light, ultraviolet light, or infrared light.

(2) The genuine/counterfeit discrimination method according to the above (1), wherein all the patterns to be identified are identical.

(3) The genuine/counterfeit discrimination method according to the above (1), wherein each of the patterns is imaged and the images are compared and identified.

(4) The genuine/counterfeit discrimination method according to the above (1), wherein the identification of a visible-light pattern is indispensable.

(5) The genuine/counterfeit discrimination method according to the above (1), wherein the genuine/counterfeit discrimination object is a printed matter obtained through printing with a color ink composition prepared by coating base particles with a multilayered film to color the particles by means of the resultant interference color, and to enable the particles to show a specific interference reflection peak or interference transmission bottom in a region besides the visible light region, and dispersing the resultant powder into a dispersion medium for ink.

(6) The genuine/counterfeit discrimination method according to the above (5), wherein the base particles used in the color ink composition are a magnetic material.

(7) The genuine/counterfeit discrimination method according to the above (5), wherein the base particles used in the color ink composition are a conductive material.

(8) The genuine/counterfeit discrimination method according to the above (1), wherein the electron beam responsive pattern formed with an electron beam is identified with an electron microscope.

(9) A genuine/counterfeit discrimination object, wherein a combination of at least two of an electric field pattern, a magnetic pattern, an electron beam responsive pattern, an X-ray responsive pattern, and reflection or absorption patterns of visible light, ultraviolet light, and infrared light can be identified therein using an electric field, a magnetic field, an electron beam, an X-ray beam, visible light, ultraviolet light, or infrared light.

(10) The genuine/counterfeit discrimination object according to the above (9), which is a printed matter obtained through printing with a color ink composition prepared by coating base particles with a multilayered film to color the particles by means of the resultant interference color, and to enable the particles to show a specific interference reflection peak or interference transmission bottom in a region besides the visible light region, and dispersing the resultant powder into a dispersion medium for ink.

(11) The genuine/counterfeit discrimination object according to the above (9), which is obtained by forming a peculiar differentiation pattern on a substrate by coating with a color ink composition prepared by coating base particles with a multilayered film to color the particles by means of the resultant interference color, and to enable the particles to show a specific interference reflection peak or interference transmission bottom in a region besides the visible light region, and dispersing the resultant powder into a dispersion medium for ink.

(12) The genuine/counterfeit discrimination object according to the above (10) or (11), wherein the matter to be printed or the substrate is a sheet or plate, a woven fabric, or a knit fabric made of a paper, resin, glass, rubber, ceramic, or metal.

(13) The genuine/counterfeit discrimination object according to the above (9), which is obtained by depositing on a substrate a powder prepared by coating base particles with a multilayered film to color the particles by means of the resultant interference color, and to enable the particles to show a specific interference reflection peak in a region besides the visible light region.

(14) The genuine/counterfeit discrimination object according to the above (13), wherein the substrate is a sheet or plate, a woven fabric, or a knit fabric made of a paper, resin, glass, rubber, ceramic, or metal.

(15) A genuine/counterfeit discrimination device, comprising at least two devices selected from a device for identifying an electric field pattern, a device for identifying a magnetic pattern, a device for identifying an electron beam responsive pattern, a device for identifying an X-ray responsive pattern, a device for identifying a visible-light pattern, a device for identifying an ultraviolet-light pattern, and a device for identifying an infrared-light pattern, and further comprising a device for comparing and identifying patterns obtained with the above identification devices.

(16) The genuine/counterfeit discrimination device according to the above (15), which indispensably has the device for identifying a visible-light pattern.

(17) The genuine/counterfeit discrimination device according to the above (15), wherein the device for identifying an electron beam responsive pattern is an electron microscope.

Incidentally, the term printing as used in the above (10) means that many identical genuine/counterfeit discrimination objects are produced. The matters obtained through this printing include ordinary bar code-printed matters, prepaid cards, postage stamps, tickets, and the like. Furthermore, the term coating as used in the above (11) means that one, or an extremely small number of, peculiar genuine/counterfeit discrimination objects is produced. The matters obtained through this coating include securities, such as bank notes, checks, and stock certificates, internal secret documents, and the like.

By each of the printing and coating, an identification pattern can be formed over the whole surface of, or in a specific area of, the surface of the matter to be printed or the surface of the substrate.

BEST MODE FOR CARRYING OUT THE INVENTION

Figure 1:
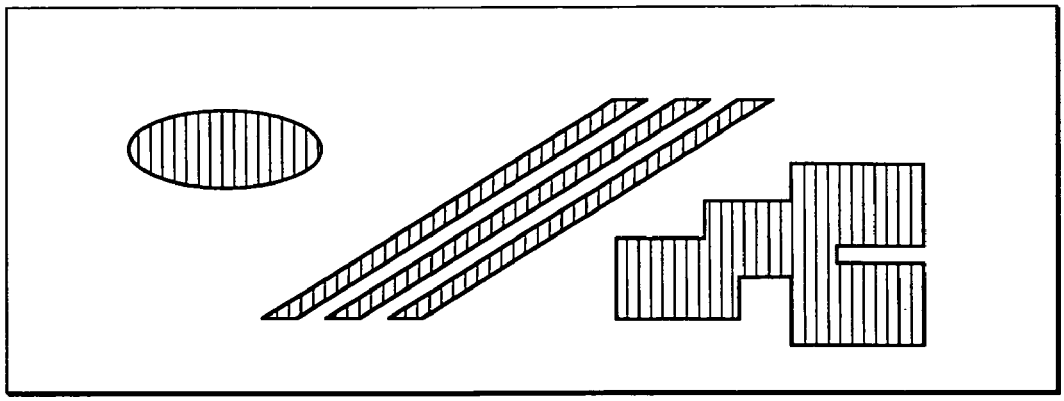
FIG. 1 is a view showing the image pattern (visible-light pattern) on the printed matter obtained through printing in an Example.

Subjects suitable for genuine/counterfeit discrimination by the method and device of the present invention are not particularly limited, and are thought to include the following.

1) A genuine/counterfeit discrimination object which has, on a part thereof, a powder composed of fine particles coated with films (film-coated powder) and is to be judged as being genuine or counterfeit based on the function of the powder.

2) The genuine/counterfeit discrimination object according to the above 1), wherein the film-coated powder is present evenly on a substrate.

3) The genuine/counterfeit discrimination object according to the above 1), wherein the film-coated powder is present unevenly on a substrate so as to form a peculiar pattern or the like, and the pattern (figure) formed is to be detected as a fluorescent pattern, a magnetically detectable pattern, an electric-field-changing pattern, a visible-light-reflecting pattern, an ultraviolet- or infrared-light-reflecting pattern, or an electron beam-reflecting pattern.

4) The genuine/counterfeit discrimination object according to the above 3), wherein the pattern formed on the substrate is a design formed by the presence of film-coated powders, and a film-coated powder having a special function is used for a specific part of the design, whereby the appearance and the information recording pattern differ from each other in information recorded therein.

5) The genuine/counterfeit discrimination object according to the above 3), wherein the pattern formed on the substrate is a design formed by a combination of one or more film-coated powders with a conventionally known pigment, and a film-coated powder having a special function is used for a specific part of the design, whereby the appearance and the information recording pattern differ from each other.

6) The genuine/counterfeit discrimination object according to the above 1), wherein the film-coated powder is a filler which is responsive to an electric field, a magnetic field, an electron beam, visible light, ultraviolet light, or infrared light and has been incorporated in a sheet or plate-form substrate.

7) The genuine/counterfeit discrimination object according to the above 6), wherein the substrate comprises fibers, in particular, organic fibers, such as botanical fibers or chemically synthesized fibers.

8) The genuine/counterfeit discrimination object according to the above 6), wherein the substrate is a resinous solid, such as a plastic.

9) The genuine/counterfeit discrimination object according to the above 6), wherein the substrate comprises inorganic fibers, such as glass fibers.

10) A genuine/counterfeit discrimination object on which an enlarged pattern of visible light, an electron beam, or the like is identified with a device, such as a microscope or electron microscope.

11) The genuine/counterfeit discrimination object according to the above 10), wherein patterning is conducted based on the distribution of the film-coated powder described in the above 1) and differentiation is conducted based on the resultant particular (singular) pattern.

12) A genuine/counterfeit discrimination object on which a pattern formed by the distribution, color, magnetic intensify, etc. of the film-coated powder described in the above 1) is identified as the particular (singular) pattern.

13) The genuine/counterfeit discrimination object according to any one of the above 1) to 12), wherein the pattern or the like has been precisely positioned.

14) The genuine/counterfeit discrimination object according to any one of the above 1) to 13), wherein a frame (mark) indicating the position of the differentiation part is used for precisely detecting the part.

15) The genuine/counterfeit discrimination object according to the above 14), wherein the frame has been formed with a film-coated powder.

16) A genuine/counterfeit discrimination object on which a pattern of image signals from a scanner, CCD, or the like has been formed.

17) A genuine/counterfeit discrimination object characterized in that the pattern formed by the distribution of the film-coated powder according to the above 1) is something peculiar to a person, such as a fingerprint, signature, imprint, or eyeball retina pattern.

18) The genuine/counterfeit discrimination object according to the above 1), which is used for the genuine/counterfeit discrimination of magnetic recording media.

19) The genuine/counterfeit discrimination object according to the above 18), which is a magnetic card or a security.

20) The genuine/counterfeit discrimination object according to the above 18), which contains information for personal (corporate) identification.

21) A genuine/counterfeit discrimination object which is a writing or document, such as an official document, corporate internal document, or personal document, or an important document, such as a certificate, and has in a part thereof a hidden pattern, such as a mark, corporate seal, or confidential seal, formed by a technique, such as printing, sealing, or coating and which, based on the hidden pattern, can be differentiated from a counterfeit made by a third person.

22) A method and device for differentiation from forgeries based on sealing, etc. which are for use in the differentiation according to the above 21).

The genuine/counterfeit discrimination objects mentioned above can be used as a magnetic card, cash card, prepaid card, merchandise coupon, boarding ticket, commuter pass, and coupon ticket (tickets, such as a vehicle ticket, boat ticket, and airline ticket), securities, such as a stock certificate and a bond, e.g., a bond issued by a local self-governing body or a corporate bond, certificates, such as an employee certificate, membership card, check card, membership certificate, and complimentary ticket, an electronic key, identification cards for personal, corporate, and other use, such as a pass card and ID card, keys, identification marks for counterfeit prevention, such as color MICR and a color bar code, and matters employing these.

Furthermore, the hidden pattern, such as a mark, corporate seal, or confidential seal, formed in part of a document, such as an official document, corporate internal document, or personal document, or an important document, such as a certificate, notarial deed, title deed, or right transfer certificate, made by a technique, such as printing, sealing, or coating can be used for preventing counterfeit committed by a third person, or for differentiation from a counterfeit made by a third person.

Moreover, examples of the substrate of the above-described genuine/counterfeit discrimination object include a sheet or plate, a woven fabric, or a knit fabric made of a paper, resin, glass, rubber, ceramic, or metal, and the like.

Especially preferred examples of the above-described genuine/counterfeit discrimination object include a printed matter obtained through printing with a color ink composition prepared by coating base particles with a multilayered film to color the particles by means of the resultant interference color, and to enable the particles to show a specific interference reflection peak in a region besides the visible light region, and dispersing the resultant powder into a dispersion medium for ink, in particular, with the color ink composition in which the base particles have magnetism, such as that described in JP-A-10-60350.

A method for the genuine/counterfeit discrimination of a printed matter obtained through printing with the color ink composition described above will be explained next in detail.

Figure 3:
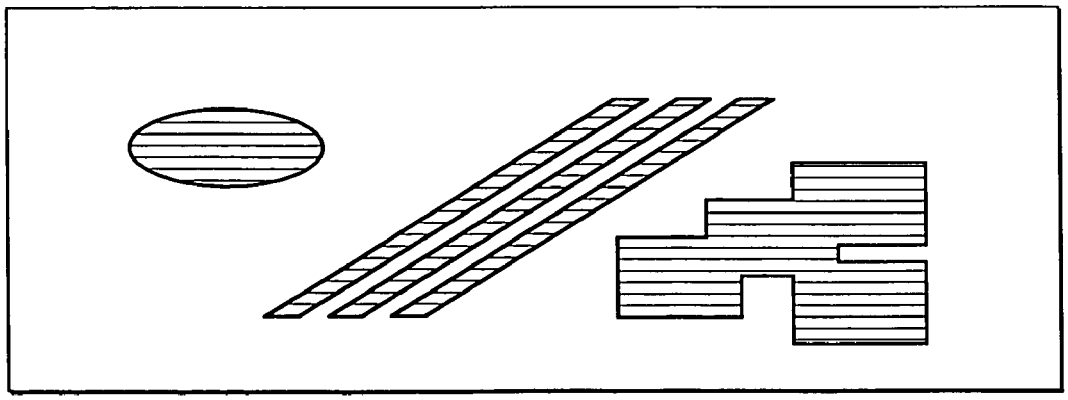
FIG. 3 is a view showing the magnetic pattern on the printed matter obtained through printing in an Example.

For example, the color ink composition described above (which has an interference reflection peak in the ultraviolet region and in which the base is a magnetic material) is used to print an image pattern of the shape shown in FIG. 3. On the printed matter thus obtained, an image (visible-light) pattern of the same shape as in FIG. 1 is observed in visible light, i.e., when identified with the naked eye.

This printed matter was irradiated with ultraviolet and examined for a reflection pattern. As a result, an ultraviolet reflection pattern of the shape shown in FIG. 2 was obtained. This pattern has the same shape as the visible-light pattern shown in FIG. 1.

Furthermore, this printed matter was examined with a magnetic reader for a magnetic pattern. As a result, a magnetic pattern of the shape shown in FIG. 3 was observed. This magnetic pattern also has the same shape as the visible-light pattern shown in FIG. 1.

These three patterns are compared and identified. For example, these three patterns are superposed. When the patterns coincide in shape with each other, the printed matter can be judged as being genuine. If the patterns do not coincide with each other, the printed mater can be judged as being counterfeit.

According to the genuine/counterfeit discrimination method of the present invention, more accurate genuine/counterfeit discrimination is possible by further conducting identification of a pattern formed with fluorescence, phosphorescence, or the like in addition to the above-described identification of patterns formed with an electric field, a magnetic field, an electron beam, visible light, ultraviolet light, and infrared light.

In the case of a printed matter having a visible-light pattern and another pattern among the patterns shown above, the visible-light pattern may have one or more visible light colors.

Furthermore, when a conventional colorant or the like which has the same visible light color and is not a colorant according to the present invention is used for coloring to form an area in which no pattern other than the visible-light pattern appears, and the pattern other than the visible-light pattern is printed with a visible-light pattern (excluding fluorescence and phosphorescence) only, then the counterfeit-preventive effect can be heightened further. In this case, with respect to visible-light patterns, it is desirable to cause the differentiation device to memorize a counterfeit-preventive-pattern printing area beforehand or to add beforehand a counterfeit-preventive pattern according to the present invention with which patterns other than visible-light patterns can be formed.

It is preferred that the position and area of each pattern of the present invention to be formed be suitably selected/determined according to the printed matter.

The device for use in the genuine/counterfeit discrimination method of the present invention is not particularly limited as long as it comprises at least two devices selected from a device for identifying an electric field pattern, a device for identifying a magnetic pattern, a device for identifying an electron beam responsive pattern, a device for identifying a visible-light pattern, a device for identifying an ultraviolet-light pattern, and a device for identifying an infrared-light pattern and further comprises a device for comparing and identifying patterns obtained with these identification devices. However, a device which indispensably has a device for identifying a visible-light pattern is preferred.

Figure 5:
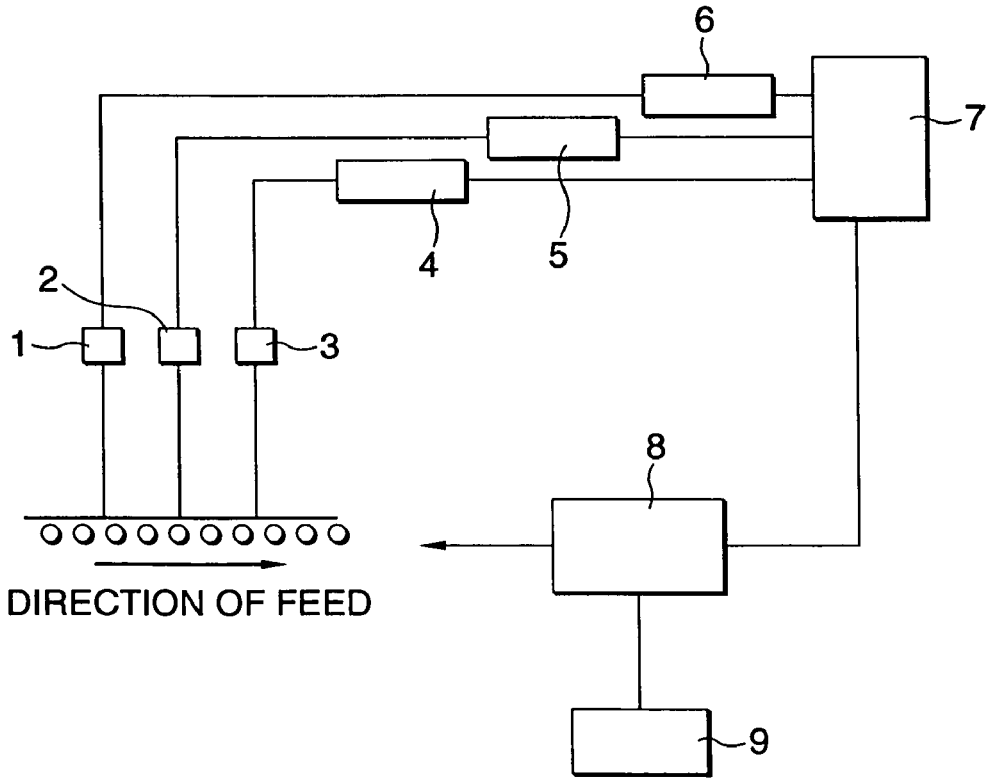
FIG. 5 is a diagrammatic view showing one embodiment of the genuine/counterfeit discrimination device of the present invention. Numerals 1, 2, and 3 denote sensors, Numerals 4, 5, and 6 converters, Numeral 7 an image comparison/differentiation device, Numeral 8 an operating machine, and Numeral 9 a genuine/counterfeit display.

Specific examples thereof include the device shown in FIG. 5.

The device shown in FIG. 5 comprises sensors 1, 2, and 3 as devices for identifying at least two of an electric field pattern, magnetic pattern, electron beam responsive pattern, visible-light pattern, ultraviolet-light pattern, and infrared-light pattern and converters 4, 5, and 6 for converting the information detected by the sensors into respective image patterns, and further comprises image comparison/differentiation device 7 for comparing and identifying image patterns obtained with these identification devices, operating machine 8 that performs a desired operation based on the information obtained with image comparison/differentiation device 7, and genuine/counterfeit display 9 that displays the genuine/counterfeit discrimination results.

Usable as sensors 1, 2, and 3 are: electric-field variable meters, such as a metal detector, for the identification of an electric field pattern; magnetism variable meters, such as a magnetic head and magnetism detector, for the identification of a magnetic pattern; various (optical or electronic) microscopes or optical sensors for the identification of an electron beam responsive pattern; and photometric devices, such as a spectrophotometer and optical sensor, for the identification of a visible-light, ultraviolet-light, or infrared-light pattern. In the case of using a spectrophotometer or the like, it is preferred to bring the sensing part thereof into a dark-room state because the ambient light may be noise thereto.

When the subject being judged as being genuine or counterfeit is judged as being genuine, operating machine 8 performs an operation, such as money exchanging, conversion into money, ticket issue, or providing an article. Conversely, when the subject is judged as being counterfeit, operating machine 8 performs an operation, such as returning the subject, holding the subject therein, or informing a public peace agency, such as the police or a security company.

The present invention will be explained below in more detail by way of Examples. However, the present invention should not be construed as being limited to these Examples only.

EXAMPLE 1

By reference to Example given in JP-A-10-60350, a powder having interference reflection peaks respectively at 500 nm in the visible region and at 320 nm in the near ultraviolet region due to a multilayered film was prepared from a magnetite powder as base particles. Sixty-five parts of the powder was mixed with 35 parts of a vehicle to prepare a color ink composition. Thereafter, the ink composition was printed on a coat paper to form the pattern shown in FIG. 1. On this printed matter, an image pattern (visible-light pattern) which was blue-green and had the same shape as in FIG. 1 was observed with the naked eye.

Furthermore, the printed matter was examined with the genuine/counterfeit discrimination device shown in FIG. 5 (identification of three patterns, i.e., visible-light, magnetic, and ultraviolet-light patterns).

Figure 2:
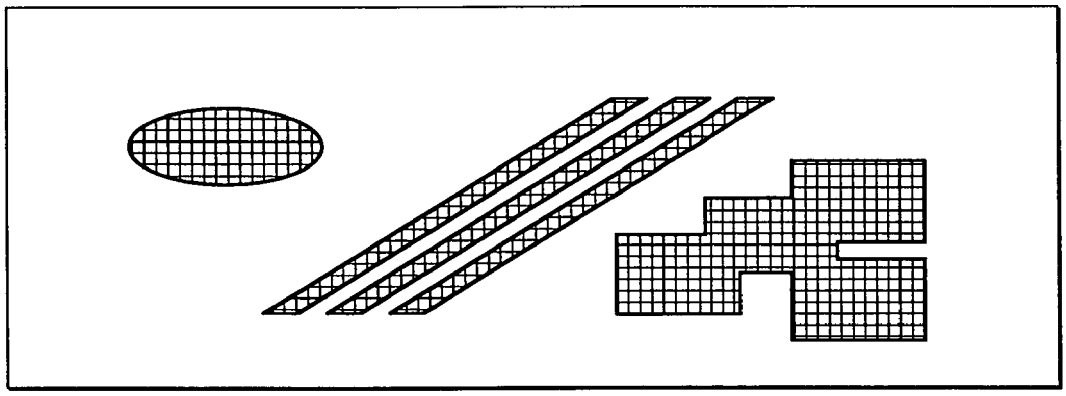
FIG. 2 is a view showing the ultraviolet pattern on the printed matter obtained through printing in Example 1.

As a result, an ultraviolet-light pattern of the shape shown in FIG. 2 and a magnetic pattern of the shape shown in FIG. 3 were identified. These patterns were identical in shape with the visible-light pattern shown in FIG. 1. When the three patterns were compared by means of image comparison/differentiation device 7 of the genuine/counterfeit discrimination device shown in FIG. 5, all these patterns coincided. These results show that the printed matter obtained through printing with the ink composition described above can be judged as being genuine or counterfeit.

COMPARATIVE EXAMPLE 1

Thirty parts of a green pigment was mixed with 20 parts of a magnetite powder, 20 parts of a titania powder, and 30 parts of a vehicle to prepare a color ink composition. Thereafter, the ink composition was printed on a coat paper to form the pattern shown in FIG. 1. On this printed matter, an image pattern (visible-light pattern) which was dark-green as compared with the printed matter obtained in Example 1 and had the same shape as in FIG. 1 was observed with the naked eye. This dark color is thought to be attributable to the influence of the black-brown color of the magnetite powder on the printed matter because the magnetite powder was merely mixed with the green pigment. Even through this examination with the naked eye only, the printed matter can be differentiated from the printed matter obtained in Example 1. However, since there may be influences of fouling, etc., this printed matter was examined with the genuine/counterfeit discrimination device in the same manner as in Example 1. Thus, accurate genuine/counterfeit discrimination was attempted.

Figure 4:
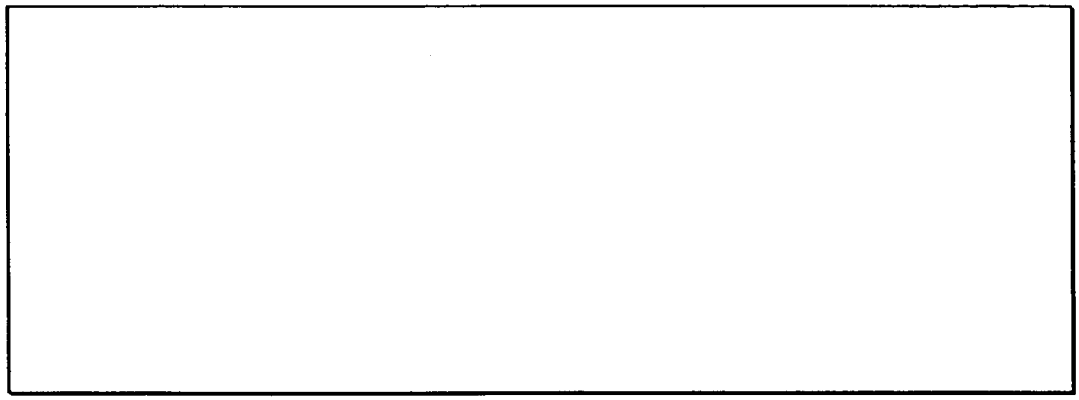
FIG. 4 is a view showing the results of an examination for an ultraviolet pattern of the printed matter obtained through printing in Comparative Example 1.

As a result, no ultraviolet-light pattern was recognized as shown in FIG. 4, and a magnetic pattern of the shape show in FIG. 3 was recognized. When these patterns were compared by means of image comparison/differentiation device 7, of the genuine/counterfeit discrimination device shown in FIG. 5, all these patterns did not coincide. Consequently, the printed matter obtained through printing with the ink composition described above could be judged as being counterfeit.

EXAMPLE 2

Substrate Production: Magnetic Card:

By reference to Example given in JP-A-7-90310, a barium ferrite (platy; average particle diameter, 1.5 μm in terms of major-axis length) base was coated with four coating layers to produce white powder A.

Next, barium ferrite was applied in a thickness of 50 μm to a given area on a substrate made of a plastic while magnetically orienting the ferrite.

Furthermore, the four-layer-coated white powder A was mixed with each of existing organic pigments of different colors to prepare a magnetic blue pigment composition, magnetic red pigment composition, and magnetic yellow pigment composition. These compositions were applied, while being magnetically oriented, so as to hide part of the barium ferrite-coated area.

Subsequently, there were prepared a nonmagnetic blue pigment composition, nonmagnetic red pigment composition, and nonmagnetic yellow pigment composition, that did not contain the white powder A and that respectively comprised existing organic pigments of the colors. These compositions were applied so as to hide other parts of the barium ferrite-coated area.

The surface was further coated with a vinyl layer having a thickness of 5 μm as a protective layer.

Signals were recorded with a magnetic head in the area in which the magnetic pigment compositions containing the white powder A had been applied on the barium ferrite-coated area, and the signals recorded were then read with the head. Furthermore, signals were recorded with a magnetic head in the area in which the nonmagnetic pigment compositions, which did not contain the white powder A, had been applied on the barium ferrite-coated area, and the signals recorded were then read with the head.

When the signal intensity for the area coated with the magnetic pigment compositions was taken as 100%, the signal intensity for the area coated with the nonmagnetic pigment compositions was as low as 27%.

As demonstrated above, the hiding of the conventional barium ferrite-coated area, which is black-brown, by the magnetic pigment compositions of the respective colors produced with the white powder A has made it possible to attain higher-intensity magnetic recording as compared with the hiding by the nonmagnetic pigment compositions. Simultaneously therewith, a design of colors which have been unusable can be formed on the magnetic recording side. Thus, a high degree of counterfeit prevention has become possible.

EXAMPLE 3

Method of Differentiation with Microscope:

Using a powder of magnetite yielded in Kamaishi mine as a starting material, blue powder B (average particle diameter, 31 μm) was produced by alternately depositing silica and titania in four layers on the surface of the magnetite powder by the method according to JP-A-10-60350.

On the other hand, five plastic pieces (long side, 8 cm; short side, 5 cm) were prepared and designated respectively as Nos. 1 to 5. In a central part of each of these, a black frame having a side length of 3 mm and a line width of 50 μm was printed beforehand.

The area in each frame was coated in a thickness of 10 μm with a solvent containing a cyanoacrylate resin as a binder dissolved therein. Subsequently, the blue powder B was applied thereto and the coating was dried. Thereafter, the particles remaining unadherent were removed by blowing compressed air.

The area in the black frame on each plastic piece, on which the blue powder had been applied, was examined with an optical microscope and an electron microscope while utilizing the black frame as a mark for positioning. The images detected were introduced into the area in the black frame.

Furthermore, the images incorporated from the plastic pieces No. 1 to No. 5 through the optical microscope were resolved into R, G, and B colors by image processing.

Each of the plastic pieces No. 1 to No. 5 did not coincide with any of the others in optical microscope image, resolved-color images, and electron microscope image (reflected electron image). Namely, each of these images is a peculiar pattern for differentiation; they are not identical, and this can be utilized for identifying the individual plastic pieces. In other words, by using the above-described method to form inexpensive peculiar differentiation patterns incapable of reproduction and to register the patterns, an advanced technique for individual identification and counterfeit prevention can be established.

EXAMPLE 4

Magnetic Identification 2:

Magnetic Identification with Magnetic Shielding Pattern and Identification with Electric Field:

Using a spherical magnetite powder (average particle diameter, 2.3 μm) as a starting material, yellow powder C was produced by depositing silica, silver, and titania films, in this order, on the surface of the magnetite powder in regulated thicknesses by the method according to JP-A-7-90310.

Sixty grams of this yellow powder C was added to an acrylic solution that was placed in a stainless-steel vessel and prepared beforehand by dissolving 50 g of a transparent acrylic in 300 ml of benzene. The mixture was stirred with a motor until it became homogeneous, and was stirred in a draft to gradually evaporate the benzene. After the benzene was evaporated to such a degree that the mixing with the motor became impossible, about 70 g of the mixture was placed on a square iron plate having a thickness of about 10 mm coated on its upper side with a surfactant as a release agent. Plates having a thickness of 0.5 mm and a side length of 1.5 cm were placed on this square iron plate at the four corners and the center, and a square iron plate of the same size having a thickness of about 10 mm coated on its lower side with a surfactant was placed thereon. The iron plates superposed were allowed to stand for 10 hours to dry the mixture.

Subsequently, the resultant acrylic plate was peeled from the iron plate on each side thereof. An acrylic piece of a necessary size (thickness, about 0.5 mm; long side, 8 cm, short side, 5 cm) was cut out of the acrylic formed. Five aluminum foil strips having a width of 3 mm and a length of 5 cm were placed on a surface thereof at an interval of 3 mm, and an epoxy resin was applied thereon. This acrylic piece was sandwiched again between the iron plates used for molding and allowed to stand for 10 hours to set the resin.

Thereafter, the acrylic plate was separated from the iron plate on each side thereof.

The acrylic piece had a striped pattern consisting of the yellow background, which contained the magnetic powder, and silver aluminum foil areas.

This acrylic piece was scanned with a magnetic head perpendicularly to the stripes. As a result, the areas in which the magnetic powder could be seen showed higher magnetic intensity than the aluminum foil areas. Specifically, the ratio of the intensity for the magnetic-powder areas to that for the aluminum foil areas was 100/43.

Since the distance between the magnetic head and the acrylic piece was almost constant, it is thought that the aluminum foil functioned as a magnetic shield to bring about such an intensity ratio.

Furthermore, a white coating material prepared by mixing titanium oxide (white pigment) with an acrylic resin (vehicle) and an alcohol (solvent) was evenly applied to the acrylic piece described above to hide the whole pattern.

This surface was scanned with a magnetic search coil. As a result, the value of current changed at the aluminum foil areas.

It was found that differentiation can also be conducted based on a change in electric field through identification of the positions of the aluminum foil, i.e., a conductor.

Although yellow powder C was supported (incorporated or surface-deposited) on an acrylic plate in this Example 4, it is possible to support it on a piece of paper, glass, rubber, ceramic, or metal in place of the acrylic plate.

EXAMPLE 5

Figure 6:
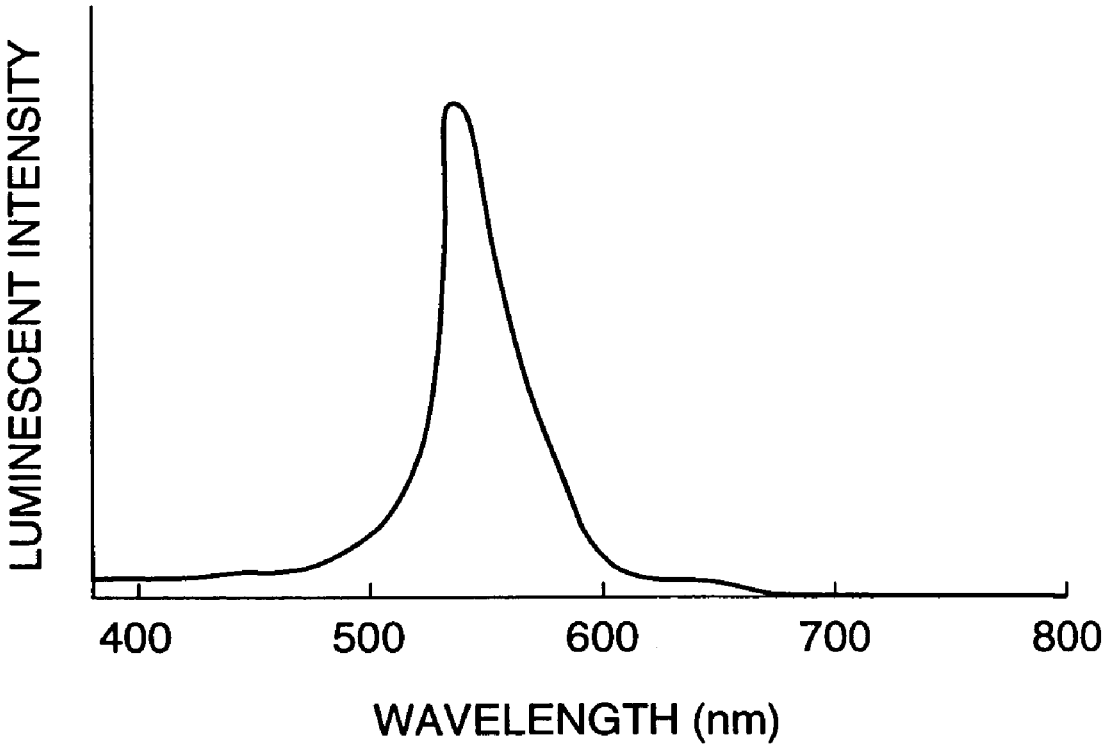
FIG. 6 is a presentation showing the fluorescent characteristics of fluorescent substance $(BaO, MgO)_8Al_2O_3$.

Differentiation of Hidden Pattern with Fluorescence and Magnetism:

A magnetic iron powder, having a particle diameter of 0.7 μm, was coated with a 0.03 μm silica film, 0.045 μm silver film, and 0.011 μm titania film to obtain a gray magnetic powder. Furthermore, this magnetic powder was coated with fluorescent substance $(BaO, MgO)_8Al_2O_3$ having the fluorescent characteristics shown in FIG. 6. Thus, a gray-white fluorescent magnetic powder was obtained.

Each of the magnetic powder and fluorescent magnetic powder described above was mixed with a green pigment, an acrylic resin (vehicle), and an alcohol (solvent) to prepare a green magnetic ink and a green fluorescent magnetic ink in such a manner that these inks had the same color tone when viewed with the naked eye.

Furthermore, the fluorescent substance was mixed with a green pigment, an acrylic resin (vehicle), and an alcohol (solvent) to prepare a green fluorescent ink having the same color tone as the green magnetic ink and green fluorescent magnetic ink when viewed with the naked eye.

Moreover, a green pigment was mixed with an acrylic resin (vehicle) and an alcohol (solvent) to prepare a green ink having the same color tone as the green fluorescent ink, green magnetic ink, and green fluorescent magnetic ink when viewed with the naked eye.

Figure 7:
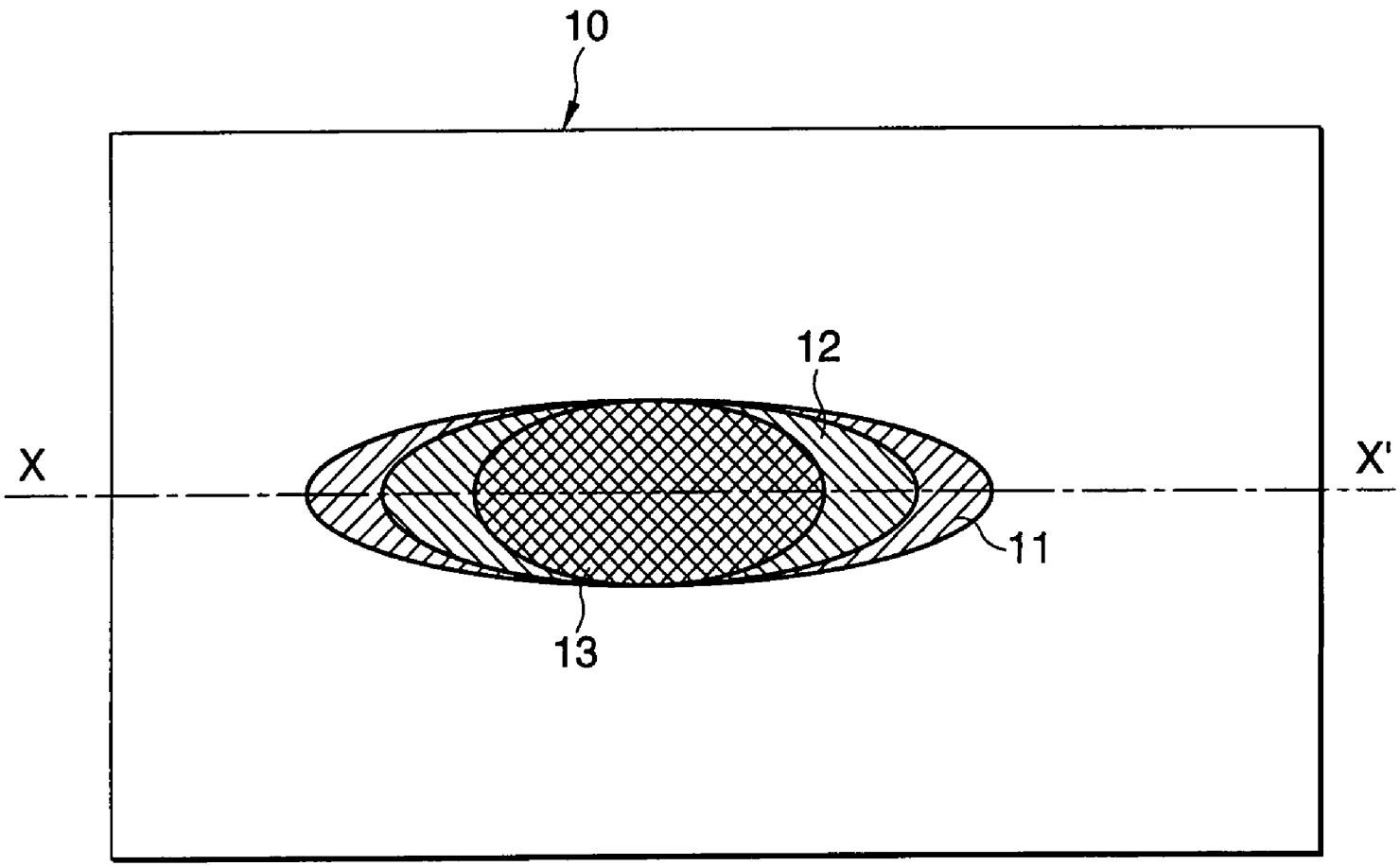
FIG. 7 is a view showing the hidden pattern in Example 5. Numeral 10 denotes a coat paper, Numeral 11 a fluorescent ink part, Numeral 12 a magnetic ink part, and Numeral 13 a fluorescent magnetic ink part.

The green fluorescent ink, green magnetic ink, and green fluorescent magnetic ink were used to draw on coat paper 10 a hidden pattern consisting of fluorescent ink part 11, magnetic ink part 12, and fluorescent magnetic ink part 13 as shown in FIG. 7.

Furthermore, the area other than the hidden pattern was evenly printed with the green ink having neither fluorescence nor magnetism. Thus, a printed matter which was wholly green when viewed with the naked eye was obtained.

Figure 8:
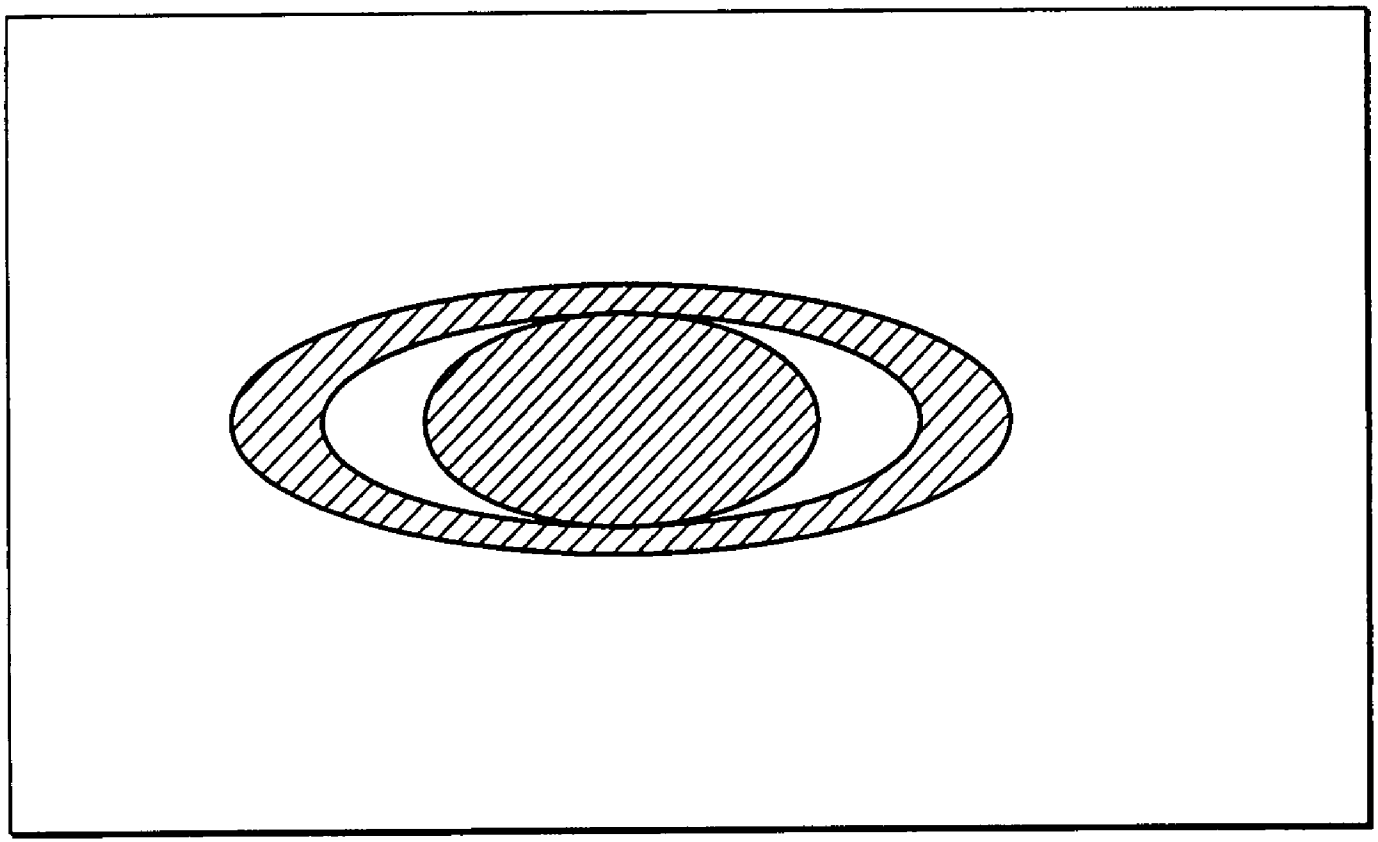
FIG. 8 is a view showing the fluorescent pattern in Example 5.
Figure 10A:
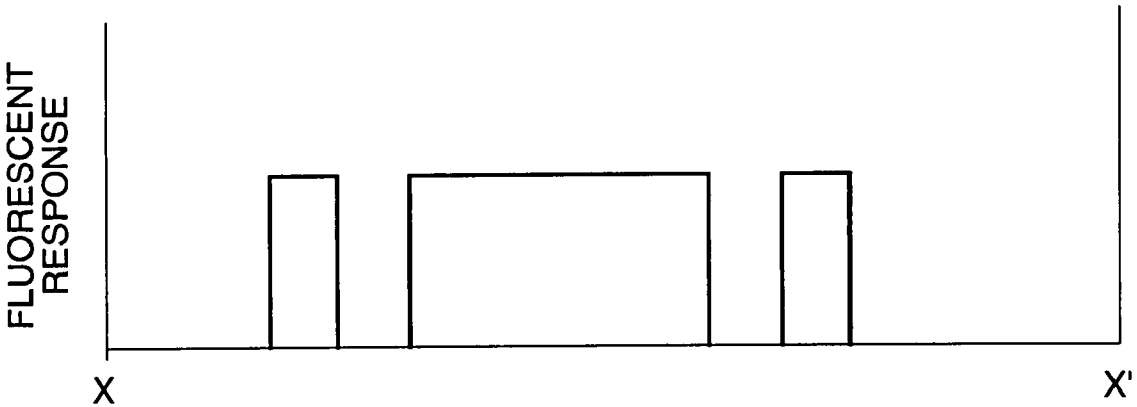
FIG. 10 is a presentation showing fluorescent and magnetic responses in X–X' in FIG. 7.
Figure 10B:
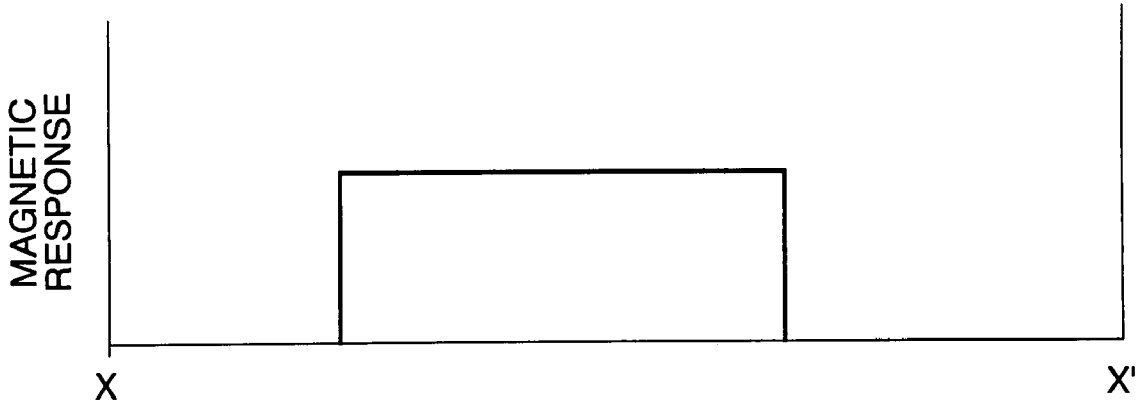

This printed matter was irradiated with 550 nm ultraviolet light. As a result, fluorescence was observed in areas of the pattern shown in FIG. 8. The line X–X' in FIG. 7 was scanned with a fluorescent-response detector, whereby the results shown in FIG. 10(*a*) were obtained.

Figure 9:
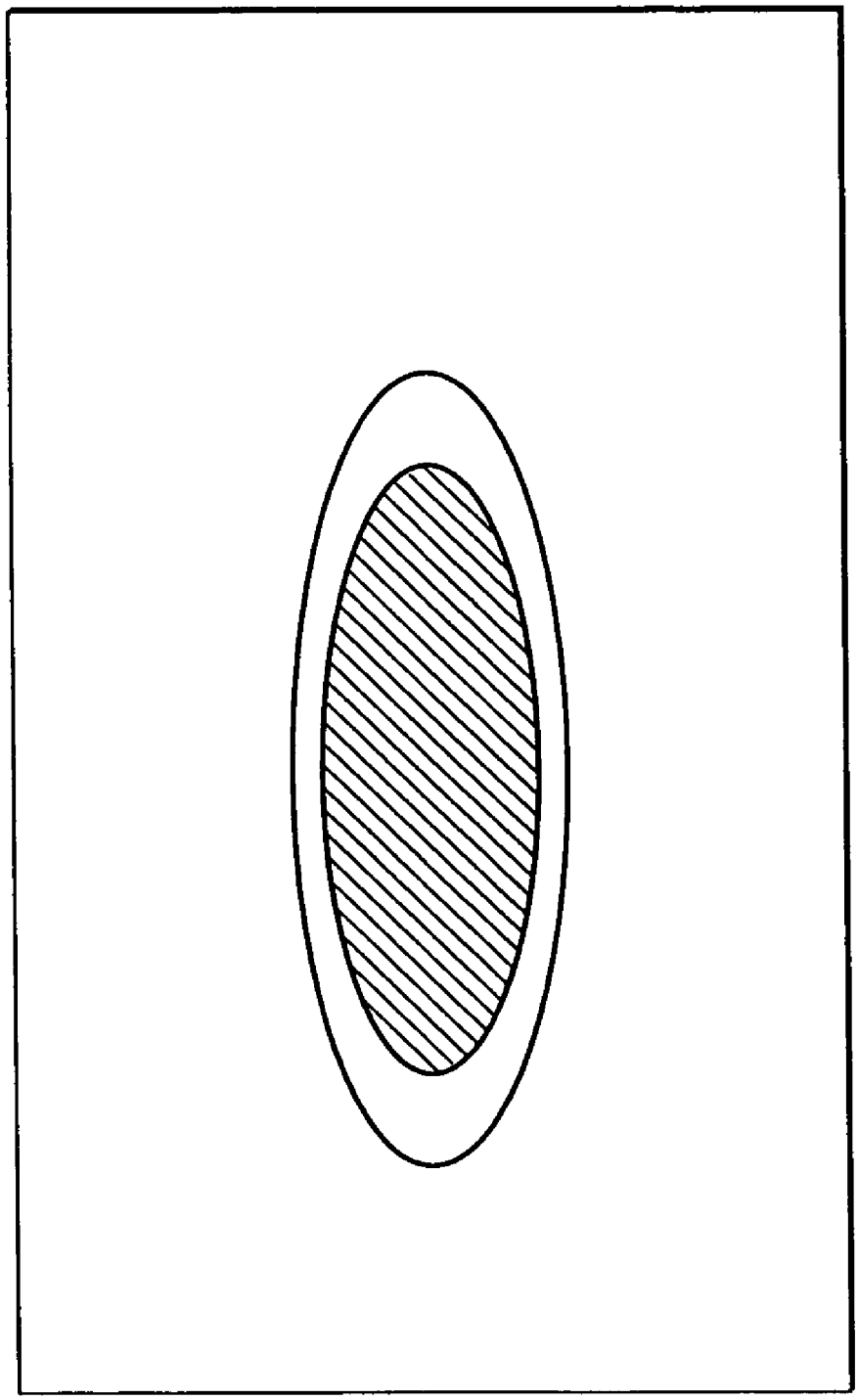
FIG. 9 is a view showing the magnetic pattern in Example 5.

Moreover, this printed matter was examined with a magnetic reader. As a result, the magnetic pattern shown in FIG. 9 was read. The line X–X' in FIG. 7 was scanned with a magnetic head, whereby the results shown in FIG. 10(*b*) were obtained.

Furthermore, a PVC wrap was printed with the green ink, fluorescent magnetic ink, and magnetic ink in this order. This printed PVC wrap was turned over and applied to a plastic paper for heat transfer. Thereafter, the area printed with the fluorescent magnetic ink was illuminated with a 40 W ultraviolet lamp in the dark. As a result, fluorescence was observed. That area was slightly attracted by a 3,500 G magnet. Thus, emission of fluorescence and a magnetic response were observed.

INDUSTRIAL APPLICABILITY

As described above, according to the genuine/counterfeit discrimination method, genuine/counterfeit discrimination object, and genuine/counterfeit discrimination device of the present invention, patterns observed based on a variety of properties are compared to conduct genuine/counterfeit discrimination. As a result, the accuracy of differentiation is heightened and the counterfeit of securities and the like becomes more impossible.

What is claimed is:

1. A genuine/counterfeit discrimination method, comprising identifying on a genuine/counterfeit discrimination object a combination of at least two of an electric field pattern, a magnetic pattern, an electron beam responsive pattern, an X-ray responsive pattern, and reflection or absorption patterns of visible light, ultraviolet light, and infrared light, using an electric field, a magnetic field, an electron beam, an X-ray beam, visible light, ultraviolet light, or infrared light, wherein the genuine/counterfeit discrimination object is a printed matter obtained by printing with a color ink composition comprising a powder of colored particles, said powder is prepared by coating base particles with a multilayered film so as to exhibit color by means of light interference, and to enable the particles to show a specific interference reflection peak in a region besides the visible light region, and said color ink composition is prepared by dispersing the powder into a dispersion medium for ink.

2. The genuine/counterfeit discrimination method according to claim 1, wherein all the patterns to be identified are identical.

3. The genuine/counterfeit discrimination method according to claim 1, wherein each of the patterns is imaged and the images are compared and identified.

4. The genuine/counterfeit discrimination method according to claim 1, wherein the identification of a visible-light pattern is indispensable.

5. The genuine/counterfeit discrimination method according to claim 1, wherein the base particles comprise a magnetic material.

6. The genuine/counterfeit discrimination method according to claim 1, wherein the base particles used in the color ink composition are comprise a conductive material.

7. The genuine/counterfeit discrimination method according to claim 1, characterized in that the electron beam responsive pattern formed with an electron beam is identified with an electron microscope.

8. A genuine/counterfeit discrimination object, having formed thereon for identification a combination of at least two of an electric field pattern, a magnetic pattern, an electron beam responsive pattern, an X-ray responsive pattern, and reflection or absorption patterns of visible light, ultraviolet light and infrared light, said at least two patterns discernible by subjecting the genuine/counterfeit discrimination object to an electric field, a magnetic field, an electron beam, an X-ray beam, visible light, ultraviolet light, or infrared light, which genuine/counterfeit discrimination object is a printed matter obtained by printing with a color ink composition comprising a powder of colored particles, said powder prepared by coating base particles with a multilayered film so as to exhibit color by means of light interference, and to enable the particles to show a specific interference reflection peak in a region besides the visible light region, and said color ink composition prepared by dispersing the powder into a dispersion medium for ink.

9. A genuine/counterfeit discrimination object, having formed thereon for identification a combination of at least two of an electric field pattern, a magnetic pattern, an electron beam responsive pattern, an X-ray responsive pattern, and reflection or absorption patterns of visible light, ultraviolet light and infrared light, said at least two patterns discernible by subjecting the genuine/counterfeit discrimination object to an electric field, a magnetic field, an electron beam, an X-ray beam, visible light, ultraviolet light, or infrared light, which genuine/counterfeit discrimination object is obtained by forming a peculiar differentiation pattern on a substrate by coating with a color ink composition comprising a powder of colored particles, said powder prepared by coating base particles with a multilayered film so as to exhibit color by means of light interference, and to enable the particles to show a specific interference reflection peak in a region besides the visible light region, and said color ink composition prepared by dispersing the powder into a dispersion medium for ink.

10. The genuine/counterfeit discrimination object according to claim 8 or 9, wherein the matter to be printed or the substrate is a sheet or plate, a woven fabric, or a knit fabric made of a paper, resin, glass, rubber, ceramic, or metal.

11. A genuine/counterfeit discrimination device, comprising means for identifying on a genuine/counterfeit discrimination object a combination of at least two of an electric field pattern, a magnetic pattern, an electron beam responsive pattern, an X-ray responsive pattern, and reflection or absorption patterns of visible light, ultraviolet light, and infrared light, using an electric field, a magnetic field, an electron beam, an X-ray beam, visible light, ultraviolet light, or infrared light, wherein the genuine/counterfeit discrimination object is a printed matter obtained by printing with a color ink composition comprising a powder of colored particles, said powder is prepared by coating base particles with a multilayered film so as to exhibit color by means of light interference, and to enable the particles to show a specific interference reflection peak in a region besides the visible light region, and said color ink composition is prepared by dispersing the powder into a dispersion medium for ink, and wherein all the patterns to be identified are identical, said device comprising at least two devices selected from a device for identifying an electric field pattern, a device for identifying a magnetic pattern, a device for identifying an electron beam responsive pattern, a device for identifying an X-ray responsive pattern, a device for identifying a visible-light pattern, a device for identifying an ultraviolet-light pattern, and a device for identifying an infrared-light pattern and further comprising a device for comparing and identifying patterns obtained with these identification devices.

12. The genuine/counterfeit discrimination device according to claim 11, which indispensably has the device for identifying a visible-light pattern.

13. The genuine/counterfeit discrimination device according to claim 11, wherein the device for identifying an electron beam responsive pattern is an electron microscope.

* * * * *